US006827351B2

(12) United States Patent
Graziani et al.

(10) Patent No.: US 6,827,351 B2
(45) Date of Patent: Dec. 7, 2004

(54) LINK MECHANISM OF SURGICAL ROBOT

(75) Inventors: Franco Graziani, Florence (IT); Massimo Iacobelli, Florence (IT); Simone Pratesi, Florence (IT)

(73) Assignee: Nuovo Pignone Holding S.p.A., Florence (IT)

( * ) Notice: Subject to any disclaimer, the term of this patent is extended or adjusted under 35 U.S.C. 154(b) by 8 days.

(21) Appl. No.: 10/206,060

(22) Filed: Jul. 29, 2002

(65) Prior Publication Data

US 2003/0030228 A1 Feb. 13, 2003

(30) Foreign Application Priority Data

Aug. 9, 2001 (IT) ..... MI2001A1759

(51) Int. Cl.[7] ..... F16J 15/32
(52) U.S. Cl. ..... 277/436; 277/552
(58) Field of Search ..... 277/434–435, 277/436–437, 551–549, 552, 579, 580, 438–439, 447, 422, 448, 505, 515

(56) References Cited

U.S. PATENT DOCUMENTS

| | | | | | |
|---|---|---|---|---|---|
| 2,979,350 | A | * | 4/1961 | Lansky | 277/552 |
| 3,565,446 | A | * | 2/1971 | Nyberg | 277/558 |
| 3,678,809 | A | * | 7/1972 | Doutt | 92/86 |
| 4,880,087 | A | * | 11/1989 | Janes | 188/322.16 |
| 4,989,701 | A | * | 2/1991 | Yamaoka et al. | 188/322.17 |
| 5,135,238 | A | * | 8/1992 | Wells et al. | 277/514 |
| 5,628,516 | A | * | 5/1997 | Grenke | 277/300 |
| 6,273,231 | B1 | * | 8/2001 | Koschmieder et al. | 192/85 CA |

* cited by examiner

*Primary Examiner*—Alison Pickard
*Assistant Examiner*—Vishal Patel
(74) *Attorney, Agent, or Firm*—Nixon & Vanderhye P.C.

(57) ABSTRACT

A scraper device for a reciprocating compressor piston rod that comprises at least one scraper ring, provided with at least one lip which faces the surface of the said rod, and a box to contain the scraper ring and for centering on the rod, wherein this scraper ring is produced by means of mechanical processing of deformable plastics materials and wherein this container box is accommodated in support elements with radial play.

17 Claims, 2 Drawing Sheets

LINK MECHANISM OF SURGICAL ROBOT

BACKGROUND AND SUMMARY OF THE INVENTION

The present invention relates to a scraper device for a reciprocating compressor piston rod.

Reciprocating compressors of a common type consist of one or a plurality of cylinders inside which pistons provided with reciprocating motion slide.

As far as the kinematic control mechanism for the reciprocating motion of the piston is concerned, reference is made by way of example to the kinematic mechanisms which consist of a connecting rod and crank or a connecting rod, crank and crosshead.

The second type of transfer of reciprocating motion proposed is applied to machines which do not have a direct connection between the foot of the connecting rod and the piston, but require interposition of a stem or rod.

The rod, which however is not designed to withstand transverse forces, is guided in its straight motion by a so-called crosshead, which forces the center of the articulation between the rod and the foot of the connecting rod to move along the axis of the cylinder.

The crosshead consists of a body provided with a pin for articulation with the connecting rod, and runners, wherein the axis of the pin is at right-angles to the axis of the rod and of the runners, i.e. arranged in the shape of a cross.

In this type of compressor the rod, which is fitted between the crosshead and the piston, is thus in an intermediate position between the units of the crank mechanism which transform the motion from rotary to straight, i.e. shaft, connecting rod, bearings and the like, and the compression chamber, which is formed by a cylinder and piston.

The outer structure or casing of the reciprocating compressors has a cover which separates the crank mechanism from the compression chamber through which the rod passes, and is provided with a plurality of scraper rings fitted onto the rod itself.

A common assembly configuration consists of use of a first roughing ring and a plurality of finishing rings, disposed downstream from the roughing ring relative to the area of lubrication.

The function of the scraper rings accommodated in the separation cover of the reciprocating compressors is to prevent the lubrication oil of the crank mechanism (shaft, connecting rod, bearings and the like) from escaping from the casing towards the cylinder, since it is drawn by the piston rod.

Inefficiency of the scraper ring can result in a continual loss of oil and thus cause progressive emptying of the oil from the crank mechanism, with consequent potentially very serious damage to the compressor.

At present the problem is commonly solved by using a series of bronze or plastics scraper rings, provided with a scraper lip in order to retain the film of oil present on the surface of the rod.

These rings are produced in three or four pieces, with inclined contact surfaces, and are held together by means of a spring on the outer diameter. This design solution permits replacement of the rings with the rod fitted as required by the standards API618, which are dedicated to reciprocating process compressors.

For example a common assembly configuration consists of the use of a metal roughing scraper ring which acts initially, and is accommodated in corresponding seats provided in the inner diameter of spacer elements which constitute the cover for separation of the crank mechanism from the compression chamber of the reciprocating compressor.

In a second seat provided in the spacer element, immediately downstream from the seat which accommodates the roughing ring, the finishing rings are inserted.

However the conventional metal scraper rings have proved to have reduced efficiency in the case of rods with medium or large dimensions, for example with a diameter larger than 75 mm.

In fact, when the diameter increases, there is also an increase in the probability that the ring will have imperfections of shape, caused by the inevitable inaccuracies in mechanical processing.

The use of scraper rings produced with a large number of pieces, which is prevalent in the case of rods with a large diameter, contributes in turn towards increasing considerably the risk of encountering imperfections of shape such as to give rise to blow-by of oil.

A further disadvantage of the conventional scraper rings described consists in the fact that the rings themselves must carry out both the scraper function and the function of centering of the rod. The mechanical stresses which can be attributed to the movements of the rod in a radial direction, to which the scraper rings are exposed, contribute towards the rapid wear of the latter with consequent deterioration of the scraper function and thus the risk of detrimental blow-by of oil.

A scraper device is disclosed for a reciprocating compressor piston rod which eliminates the above-described disadvantages.

The scraper device for a reciprocating compressor piston rod uses different structural elements to carry out the scraper function and the function of centering on the piston rod.

The scraper device for a reciprocating compressor piston rod permits a saving in the maintenance costs, as well as reduced machine-stoppage times, since it is characterized by a scraper ring which is easy to replace.

The scraper device for a reciprocating compressor piston rod has low wear compared with the known type, and therefore also makes is possible to reduce substantially the costs of spare parts and maintenance inventions.

The scraper device for a reciprocating compressor rod is particularly simple and functional, and has low costs.

SUMMARY OF DRAWINGS

The characteristics and advantages of a scraper device for a reciprocating compressor piston rod according to the present invention will become more apparent from the following description provided by way of non-limiting example with reference to the attached schematic drawings in which.

DETAILED DESCRIPTION OF THE DRAWINGS

The figures show a scraper device indicated as 10 as a whole, for fitting on a reciprocating compressor piston rod 11. The scraper device 10 which is the subject of the present invention comprises a scraper ring 12 and a box 13 to contain the ring 12 and center the ring itself on the rod 11.

Figure 5:
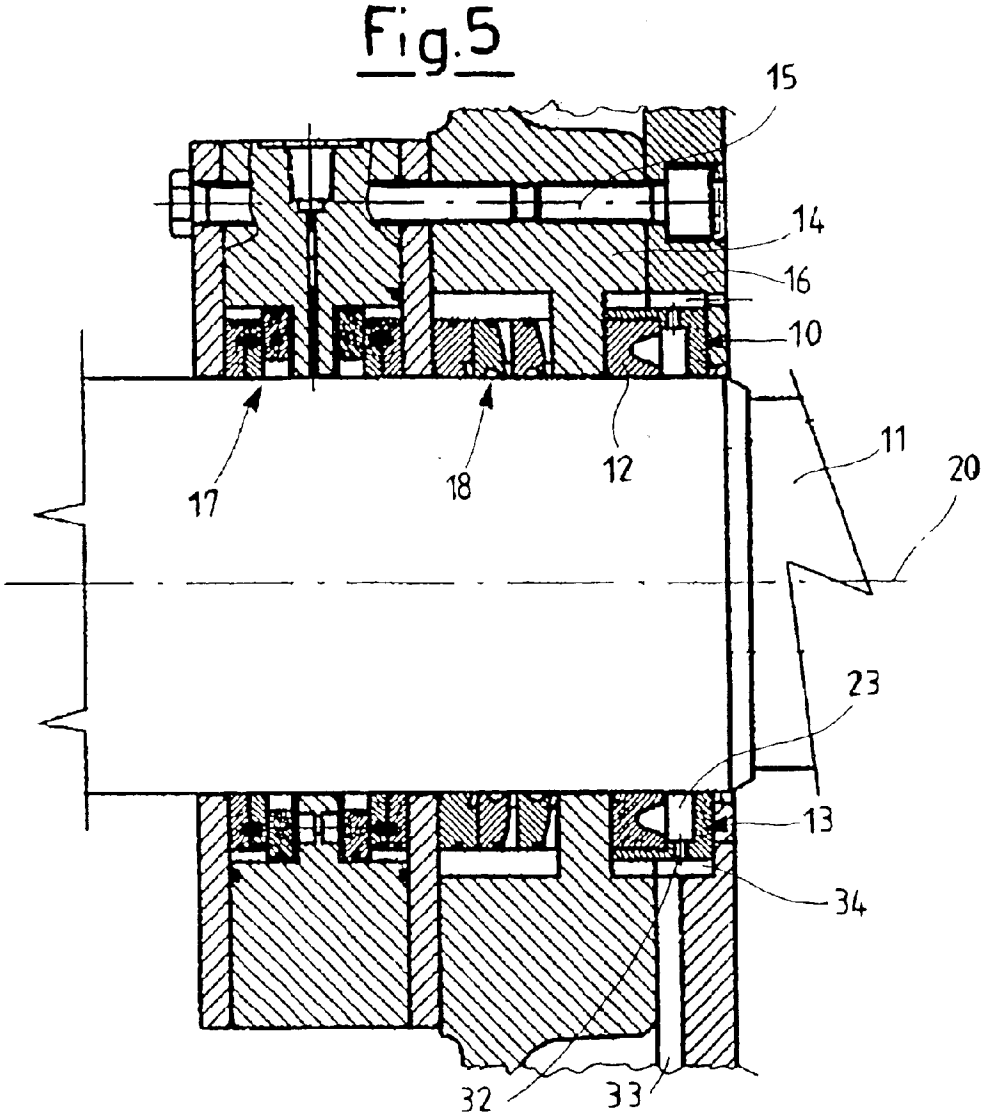
FIG. 5 shows schematically in cross-section an example of an assembly configuration of a scraper device which is the subject of the present invention, on a reciprocating compressor piston rod.

The scraper device 10 is represented in FIG. 5 fitted into corresponding seats provided in the inner diameter of support elements 14 and lateral container elements 16 which are clamped by tie rods 15. These support elements 14 and container elements 16 constitute a cover which separates the crank mechanism from the compression chamber, both of which are not shown in the figure which schematizes a possible assembly configuration.

On the side which faces the compression chamber, which is thus downstream from the scraper device, where there is no longer any lubrication, sealing means 17 are also provided. The sealing means 17 consist of corresponding seals which will not be described in greater detail since they are known to persons skilled in the art.

Simply by way of example in FIG. 5, immediately downstream from the scraper device 10, there is represented a set of three finishing rings 18 of the conventional metal type, which are already used in the state of the art and are therefore not described further.

In another assembly configuration of the scraper device 10 which is the subject of the present invention, and is not shown in the figures, it is possible to eliminate the set of three finishing rings 18, by this means obtaining an advantageous reduction in the axial dimension of the cover which separates the crank mechanism and the compression chamber.

The scraper ring 12 belonging to the scraper device 10 which is the subject of the present invention is obtained by mechanical processing of plastics material which has deformable rubbery behavior and is provided with good resistance to wear.

Simply by way of example reference is made to Viton (registered trade mark of Du Pont Dow), but use can also be made of another elastomer material which has similar characteristics of excellent resistance to heat and to aggressive chemical agents.

In the scraper ring 12 there can be determined a surface with an annular shape 19, which is substantially at right-angles to a central axis of the rod 20, and is active in evacuating the oil, and a surface with an annular shape 21 parallel to the former shape, with functions of propping the support elements 14 of the cover.

In the active surface 19 there is provided an annular groove 22, which, when the ring is accommodated in the container box 13, constitutes together with the box itself a tank 23 for accumulation of the oil.

An outer surface 24 of the scraper ring 12, which substantially has a cylindrical generatrix, has an outer lip 25 which projects slightly from the surface 24 itself, which makes it possible to make the ring 12 fit the container box 13 better in conditions of use.

On an inner surface 26 of the scraper ring 12, which is in contact with the rod 11, there are present both a first lip 27, which is produced by means of mechanical processing on an edge which faces the active surface 19, and a second lip 28, which is also produced by means of mechanical processing.

The two lips 27 and 28 interact in succession on the rod 11, both with the function of scraping the film of oil which is present on the surface of the rod 11 itself.

The scraper ring 12 is described in some of its non-exclusive embodiments, but further embodiments not shown of the scraper ring itself can also be envisaged. For example the number of lips present on the surface of contact with the rod can be different. In fact, a greater or smaller number of lips makes it possible to achieve better efficiency of removal of the oil from the surface of the rod on the basis of the conditions of use during functioning of the compressor.

Figure 4:
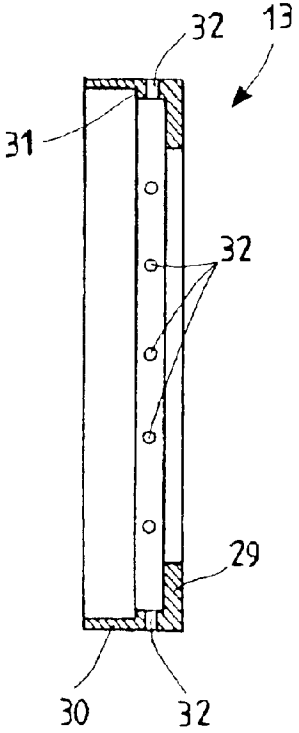
FIG. 4 is a lateral view in cross-section according to a plane which passes through a central axis of the rod, of a container box forming part of a scraper device for a reciprocating compressor piston rod, which is the subject of the present invention.

The container box 13 forming part of the scraper device 10 which is the subject of the present invention is made in a single piece and has an annular shape with a cross-section in the form of an "L", as shown both in FIG. 4 and FIG. 5, which illustrates the scraper device 10 in a configuration fitted on the rod.

The container box 13 is fitted with radial play 34 in the seats provided in the support elements 14 and in the lateral container elements 16, which are joined together by the action of the tie rods 15.

The box 13 consists of a lateral annular wall 29 which carries out the centering on the rod 11 and a perimeter wall with a cylindrical generatrix 30. This perimeter wall 30 has on the inner side a stop surface 31 against which the scraper ring 12 is accommodated, such as to be oriented with the groove 22 facing the box 13 itself in order to form the tank 23 for accumulation of the excess oil.

In the perimeter wall with a cylindrical generatrix 30 there are also provided a plurality of holes 32 for drainage of the lubrication oil from the tank 23 towards drainage grooves 33 which are provided in the support elements 14 or in the lateral container elements 16 according to known methods.

Figure 1:
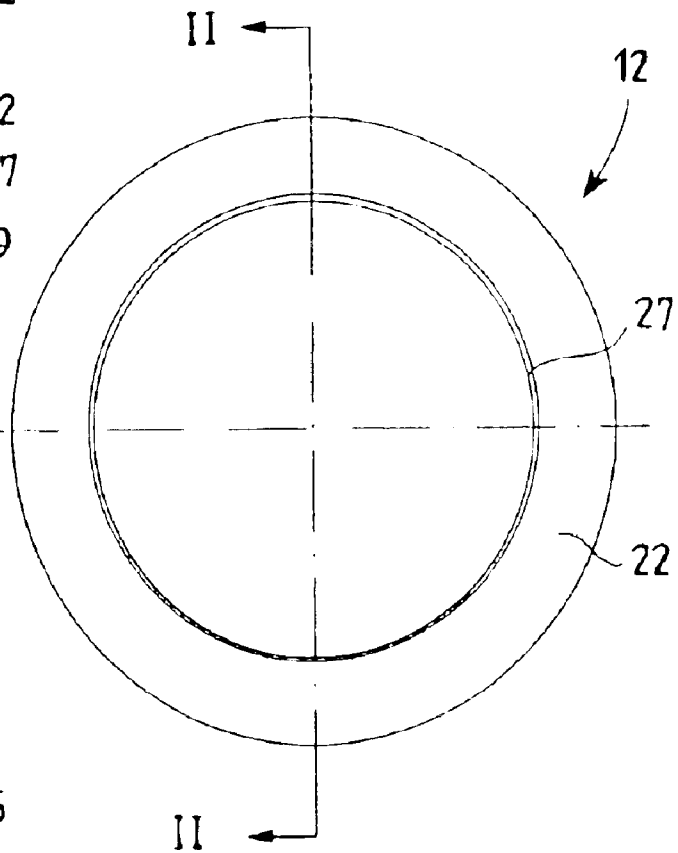
FIG. 1 is a front view of a first embodiment of a scraper ring of a scraper device for a reciprocating compressor piston rod, which is the subject of the present invention.
Figure 2:
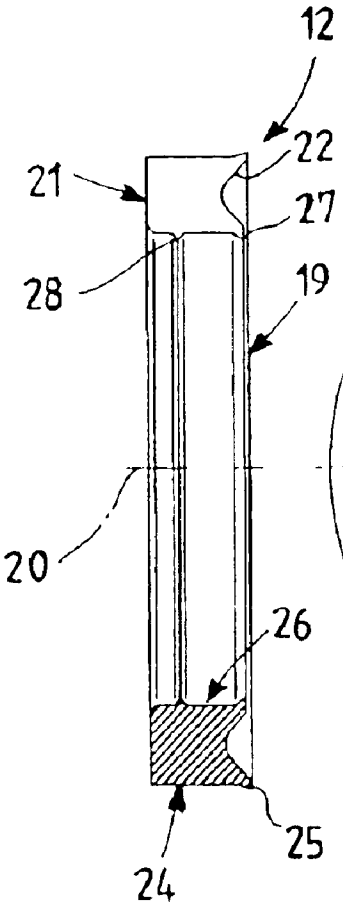
FIG. 2 is a view in cross-section of FIG. 1 produced according to the line II—II.

FIGS. 1 and 2 show the scraper ring 12 according to a first embodiment, provided with a single radial cut for fitting onto the rod, and thus consisting of a single piece.

Figure 3:
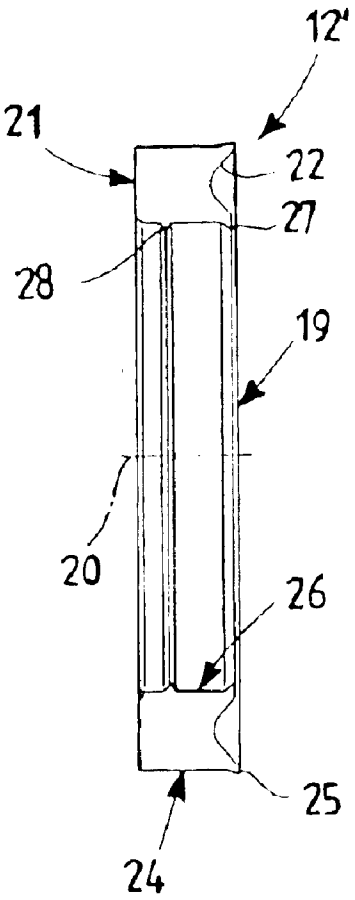
FIG. 3 is an elevated lateral view of half a scraper ring of a scraper device for a reciprocating compressor piston rod according to a second embodiment in two pieces.

On the other hand FIG. 3 shows in lateral elevation half of the scraper ring 12', produced according to a further embodiment in two different symmetrical pieces.

Both the embodiments proposed permit fitting and/or replacement without having to disconnect the rod 11 from the crosshead, as required by the reference standards API618 for process compressors.

The said scraper ring 12 or 12' is fitted with slight interference inside the container box 13 so as to ensure optimum pressure on the surface of the rod 11.

This fitting method can be implemented owing to the resilience of the scraper ring 12 itself and owing to the presence of the outer lip 25 which projects from the outer surface 24 of this scraper ring 12. In fact, the lip 25 provides the ring itself with further resilience in order to obtain the best fit in the container box 13 in conditions of use.

The fitting of the container box 13 onto the rod 11, which is carried out into corresponding seats provided in the support elements 14 and in the lateral container elements 16, is carried out with radial play 34, as previously described.

This factor enables the scraper device 10 to float freely following the radial movement of the rod 11 during functioning of the reciprocating compressor and thus to undergo reduced mechanical stresses.

The scraper ring 12, being inserted in the container box 13 and thus being free to follow the movements of the rod 11, is subjected to substantially less stress than in a conventional fitting solution.

In conditions of use the scraper ring 12 will be subjected to the inevitable phenomena of wear, which however should not be accelerated by phenomena of localized damage as a result of the stresses, and consequently subjecting the ring to deformations.

During the axial reciprocal motion of the rod of a reciprocating compressor the scraper ring 12, which is in the container box 13, and therefore follows any radial movements of the rod 11, retains the lubrication oil of the crank mechanism by scraping it from the surface of the rod 11. In an arrangement of this type the lubrication oil is conveyed with recirculation through the drainage grooves 33 provided in the support elements 14 or in the lateral container elements 16.

The scraper device 10 for a reciprocating compressor piston rod, which is the subject of the present invention, has the advantage of using plastics material with rubbery behavior which is highly suited for production of the scraper ring.

The scraper ring 12 or 12' can be deformed, and in fact is less subject to possible imperfections of shape, and is therefore particularly, but not exclusively, suitable for being fitted onto rods with a large diameter, for example of 75 mm.

In addition to the provision of separate elements to carry out the centering function and the scraper function, the device makes it possible to reduce substantially the deterioration of the individual components. In fact the container box, which carries out the centering, and is thus subjected to mechanical stresses by the radial movements of the rod, does not constitute a component which is subject to wear, but rather is advantageously directly in the lubrication area.

Furthermore the rubbery ring with scraper functions is not subjected to mechanical stresses, because it is free to follow the radial movements of the rod.

The scraper device for a reciprocating compressor piston rod which is the subject of the present invention makes it possible to obtain an increase, which is 5–10 times that of the conventional metal ring in three or four pieces, in the efficiency of the scraper function, which is evaluated as a loss of oil from the crank mechanism.

In addition, with the scraper device for a reciprocal compressor piston rod disclosed here, it is possible to obtain very lower variance of the distribution of the imperfections and thus of the behavior of the scraper ring in use.

Another advantage of the use of a scraper device for a reciprocating compressor piston rod, is the possibility of reducing drastically the axial dimension of the sealing arrangement by use only of the scraper device and elimination of the set of three finishing rings.

In addition, the use of the scraper device for a reciprocating compressor piston rod, advantageously permits replacement of the device without disconnecting the rod from the crosshead. This results in significant advantages in terms of the saving in maintenance costs and reduced machine stoppage times.

In addition there is also a reduction in the costs associated with spare parts, since the wear of the scraper devices for a reciprocating compressor piston rod, which is the subject of this invention, is advantageously reduced compared with the wear encountered on the conventional metal scraper rings.

The scraper device for a reciprocating compressor piston rod thus designed can undergo numerous modifications and variations, all of which come within the scope of the invention; in addition all the details can be replaced by technically equivalent elements. In practice any materials and dimensions can be used according to technical requirements.

What is claimed is:

1. A scraper device for a reciprocating compressor piston rod comprising:

at least one scraper ring, provided with an annular front surface facing a proximate end of the piston rod, wherein said front surface further comprises at least one lip abutting a surface of the rod, wherein said scraper ring is of formed of a deformable plastic material;

a container box containing the scraper ring and centering the ring on the rod, said container box further comprises an inner annular recess coaxial with and receiving said scraper ring and wherein the container box is held in at least one support elements which provides a radial gap between an inner wall of the support element and an outer wall of the container box, and an oil accumulation tank defined by the inner annular recess of the container box, the annular front surface of the scraper ring and the surface of the rod.

2. A scraper device according to claim 1, wherein said annular front surface of the scraper ring comprises an annular surface is at a right-angle to a central axis of the rod, and said annular front surface is active in evacuation of the oil off the rod.

3. A scraper device according to claim 1, wherein said at least one lip of the said scraper ring comprises a first lip which faces an edge of the scraper ring and a second lip on an inner surface of said scraper ring.

4. A scraper device according to claim 1, wherein said scraper ring further comprises an outer lip which projects relative to an outer surface with a substantially cylindrical generatrix of said scraper ring.

5. A scraper device according to claim 1, wherein said container box comprise an annular centering wall on the rod and a perimeter wall with a cylindrical generatrix, and said perimeter wall forms a portion of the inner annular recess of the container box.

6. A scraper device according to claim 5, wherein said perimeter wall is provided with a plurality of apertures for drainage of the oil.

7. A scraper device according to claim 5, wherein said perimeter wall has on an inner side a stop surface for positioning of said scraper ring.

8. A scraper device according to claim 1, wherein said deformable plastics material is an elastomer material resistant to heat and aggressive chemical agents.

9. A scraper device according to claim 8, wherein said elastomer material which is resistant to heat and to aggressive chemical agents, and is mechanically deformable.

10. A scraper device according to claim 1, wherein said scraper ring is a single annular unit provided with a single radial cut through the ring.

11. A scraper device according to claim 1, wherein said scraper ring is formed of a plurality of components.

12. A scraper for a piston rod in a reciprocating compressor having a stationary support container, wherein the rod moves reciprocally with respect to said support container and said container includes an annular inner groove having an outer annular surface, said scraper comprising:

an annular scraper ring having an annular front surface slidably engaging said rod, wherein said scraper ring is coaxial with said piston rod;

a container box having a first annular inner recess receiving said scraper ring and an outer peripheral surface opposite to said outer annular surface of the support container, wherein said container box is coaxial to said piston rod and seated within the annular inner groove of the support container, and a radial gap exists between the outer peripheral surface of the box and the outer annular surface of said groove, and an oil accumulation tank defined by a second annular inner recess of the container box, the annular front surface of the scraper ring and the surface of the rod.

13. A scraper as in claim 12 wherein said scraper is an oil scraper.

14. A scraper as in claim 12 wherein said scraper ring includes a front face extending radially outward from said rod and opposite to an inner peripheral radial surface of the second annular inner recess of said container box.

15. A scraper as in claim 14 wherein said front face include a recess to receive said oil.

16. A scraper as in claim 15 wherein said recess is an annular groove in the front face of the scraper ring.

17. A scraper as in claim 14 wherein said second annular inner recess includes a plurality of drainage apertures extending radially through said container box and opening to said radial gap.

* * * * *

UNITED STATES PATENT AND TRADEMARK OFFICE

CERTIFICATE OF CORRECTION

PATENT NO. : 6,827,351 B2
DATED : December 7, 2004
INVENTOR(S) : Graziani, F. et al.

It is certified that error appears in the above-identified patent and that said Letters Patent is hereby corrected as shown below:

Title page,
Item [54], Title, replace with -- SCRAPPER DEVICE FOR A RECIPROCATING COMPRESSOR PISTON ROD"

Column 1,
Line 2, insert as second paragraph -- Priority is claimed to Italian Application No. M2001 A 001759, filed August 9, 2001 --

Column 2,
Line 44, change the word "is" to the word -- it --
Line 45, change the word "inventions" to -- interventions --
Line 46, after the word "reciporcating" insert the word -- piston --
Line 46, after the word "rod" insert the word "which"

Column 6,
Line 25, delete the word "is"

Signed and Sealed this

First Day of March, 2005

JON W. DUDAS
*Director of the United States Patent and Trademark Office*